United States Patent [19]

Patzig

[11] Patent Number: 4,539,115

[45] Date of Patent: Sep. 3, 1985

[54] DEVICE FOR REMOVING CLEANING BALLS FROM A COOLING WATER STREAM

[75] Inventor: Dieter Patzig, Ratingen, Fed. Rep. of Germany

[73] Assignee: Taprogge Gesellschaft GmbH, Ratingen, Fed. Rep. of Germany

[21] Appl. No.: 574,685

[22] Filed: Jan. 27, 1984

[30] Foreign Application Priority Data

Jan. 29, 1983 [DE] Fed. Rep. of Germany ..... 3303053

[51] Int. Cl.[3] ..... B01D 29/42; F28G 1/12

[52] U.S. Cl. ..... 210/409; 210/459; 15/3.51

[58] Field of Search ..... 210/405, 420, 421, 422, 210/423, 435, 456, 459, 409, 448; 165/95; 134/8; 15/3.5, 3.51, 3.52, 104.06 A

[56] References Cited

U.S. PATENT DOCUMENTS

| | | | |
|---|---|---|---|
| 892,476 | 7/1908 | Watters | 210/422 |
| 1,050,775 | 1/1913 | Booth | 210/422 |
| 1,640,070 | 8/1927 | Drexler | 210/422 |
| 2,414,421 | 1/1947 | Small | 210/405 |
| 3,537,593 | 11/1970 | Ruthrof | 210/409 |
| 4,120,790 | 10/1978 | Tinker et al. | 210/420 |
| 4,283,807 | 8/1981 | Bizard | 15/3.51 |
| 4,304,295 | 12/1981 | Otake | 15/3.51 |
| 4,305,822 | 12/1981 | Eimer et al. | 210/405 |
| 4,311,591 | 1/1982 | Eimer et al. | 210/405 |
| 4,339,333 | 7/1982 | Sjöberg | 210/421 |
| 4,350,202 | 9/1982 | Schultz et al. | 15/3.51 |
| 4,351,387 | 9/1982 | Milia | 15/3.51 |
| 4,385,660 | 5/1983 | Koller | 15/3.51 |

FOREIGN PATENT DOCUMENTS

| | | | |
|---|---|---|---|
| 736703 | 5/1943 | Fed. Rep. of Germany | 210/422 |
| 972549 | 7/1959 | Fed. Rep. of Germany | 210/421 |
| 3303053 | 12/1983 | Fed. Rep. of Germany . | |
| 374330 | 6/1932 | United Kingdom | 210/420 |
| 881917 | 11/1961 | United Kingdom | 210/422 |

*Primary Examiner*—Richard V. Fisher
*Assistant Examiner*—Wanda L. Millard
*Attorney, Agent, or Firm*—Karl F. Ross; Herbert Dubno

[57] ABSTRACT

A collecting device for removing cleaning balls from a water stream of a power plant condenser has a comparatively short pipe section forming a housing for the pivotal sieve or sieves. A downstream end of each sieve is provided with part of the collecting trough for the balls, the other part being formed by a wall portion downstream of the downstream flange of the pipe section when the sieve is swung into its operative position. A fitting in the housing is connected to this trough by a connecting pipe.

12 Claims, 5 Drawing Figures

DEVICE FOR REMOVING CLEANING BALLS FROM A COOLING WATER STREAM

CROSS REFERENCE TO RELATED APPLICATIONS

The present application is related to the commonly assigned copending application Ser. No. 477,814 filed Mar. 23, 1983, Ser. No. 477,862 filed Mar. 22, 1983, Ser. No. 417,373, now abandoned, filed Sept. 13, 1982 and Ser. No. 478,065 filed Mar. 23, 1983.

Reference may also be had to U.S. Pat. Nos. 4,305,822 and 4,311,591, also commonly assigned with the present case.

Field of the Invention

My present invention relates to an apparatus or device for recovering cleaning balls from a cooling water stream downstream of a power plant condenser.

More particularly the invention relates to a device which can be introduced as a unit into the cooling water duct downstream of such a condenser so as to enable cleaning bodies to be removed from the cooling water.

BACKGROUND OF THE INVENTION

It is known to introduce into water about to pass through a heat exchanger, such as the condenser of an electric generating power plant, cleaning bodies whose function it is to wipe clean the heat exchange surfaces of the condenser upon entrainment of these bodies through the tube bundle of the heat exchanger.

When cleaning is accomplished by the use of such cleaning bodies, hereinafter referred to as cleaning balls and which can be composed of a foam synthetic resin, the cleaning bodies must be captured or recovered from the water downstream of the heat exchanger and, after such capture, can be recirculated to a location upstream of the condenser for reentrainment in the cooling water. As a result, the cooling balls are recirculated in a ball recirculation and cleaning system.

It is known to provide a grate, screen or grid with a bar spacing less than the diameter of the balls, in the path of the water downstream of the condenser to recover the cleaning balls therefrom, to provide a trough or the like at a low point along the stream in which the captured balls are collected and to communicate with this trough via a pipe to allow the balls to be withdrawn from the trough for recirculation.

More specifically, and as should be clear from the aforementioned copending applications and the earlier patents, it is not uncommon to provide a cleaning ball system wherein a housing in the form of a duct or pipe section has connecting flanges at the upstream and downstream ends of this pipe section to enable it to be connected in the pipeline downstream of the condenser. This pipe section, in turn, may be provided with a ball-capturing sieve which is inclined to the axis of the pipe section and is generally planar so that its downstream end, i.e. its end proximal to the wall of the pipeline, has an elliptical configuration, and means is provided at this downstream end for collecting the balls which, upon capture by the sieve, are guided to the wall of the pipeline at this downstream end. This means can include a pipe for withdrawing the collected balls.

It has been proposed previously to mount the ball-capturing sieve so that it is swingable about an axis orthogonal to the axis of the pipe section into its functional position and out of its functional position. The sieve lies athwart the stream and captures the balls therefrom whereas in its nonfunctional position the sieve lies generally parallel to or along the stream and thus is unable to intercept the balls.

The sieve can be a single member spanning the entire cross section of flow in its functional position, in which case it has an elliptical configuration at each end adapted to lie against the pipe wall. However, two sieve sections may be utilized and can be substantially symmetrically disposed on either side of a median axial plane so that upstream edges of the sieve sections come together in the functional position while the downstream ends of the sieve sections have the elliptical configuration described.

In the functional position, therefore, the two sieve sections have a coping shape, i.e. an inverted V-configuration, but are substantially parallel to one another and to this plane and the flow in the nonfunctional position.

The manner in which the device functions is, of course, the same whether the single sieve is utilized or two sieve sections are employed and throughout this description, therefore, it will be understood that reference to a single sieve or to a pair of sieves are equivalent and interchangeable and that, as far as the present invention is concerned, whatever applies to a sieve section of a double-sieve arrangement will be equally applicable to a single-sieve system except that, in the latter case, the single-sieve will span the entire flow cross section in its functional position whereas in the two-sieve arrangement, each sieve will span only half the flow cross section in the functional position.

As noted previously, in earlier arrangements, the downstream end of the sieve of a single-sieve arrangement or the downstream ends of the sieves of a double-sieve arrangement will be provided with respective collecting troughs, which may also be referred to as collecting boxes because they are generally of a box-like cross section, mounted on the housing or pipe walls and to which the balls are delivered as they are captured by the grate or sieve. Instead of full box-like structures, the ball accumulating or collecting troughs may be defined by baffles or deflectors which likewise are mounted upon the housing or pipe wall.

The pipe communicating with the trough may also be permanently or fixedly mounted on the pipe or pipe wall and serves to enable the balls to be drawn out of the trough.

In practice, this arrangement in which the ball-collecting trough is located at a fixed position on the pipe wall and the sieve or grate has a certain inclination to the axis at least in its functional position, required the entire assembly forming the ball-recovery device to be of considerable length. This poses a serious problem when the ball-collecting device is to be applied to existing condenser installations since there may simply not be room for such long collectors.

Attempts to reduce the length of the assembly by varying the inclination of the ball-carrying sieves are not possible in many cases since fairly steep angles may be required to ensure effective transport of the balls along the sieves to the collecting trough.

OBJECTS OF THE INVENTION

It is, therefore, the principal object of the present invention to provide an improved ball-collecting device for the cleaning balls of an electric power plant condenser, for example, which obviates the disadvantages enumerated above.

Still another object of this invention is to provide a device or apparatus for the purposes described which, because of its reduced length, can be utilized more readily in conjunction with previously installed power plant condensers.

Still another object of this invention is to provide a ball-capturing device which is comparatively compact without detrimental alteration of the inclination of the sieve or grate in its functional position.

SUMMARY OF THE INVENTION

These objects and others which will become apparent hereinafter are attained, in accordance with the present invention, which provides that, in the functional position of the sieve or grate, the downstream elliptical end thereof is so formed or arranged that at least in part the ball-collecting trough, box or unit is formed by a wall member which is not affixed to the sieve, i.e. which is independent of the sieve.

According to the invention, more particularly, the pipe section is provided with flanges at even ends enabling it to be connected in a pipeline, downstream of a condenser, and at least one sieve is pivotally mounted in this pipe section and can have a length in the direction of flow of the ball-entraining liquid through this pipe section which is subtantially greater than the axial length of the pipe section on which this sieve is mounted for pivotal movement between a functional position in which the sieve is inclined to the direction of flow and an inoperative position in which the sieve is substantially parallel to the flow direction.

The downstream end of this sieve may be provided with a formation constituting part of the collecting trough which is ultimately formed when the sieve is swung into its operable or functioning position, this part cooperating with the aforementioned fixed wall portion which may lie below or downstream of the downstream flange of the pipe sections to define the trough. Furthermore, according to the invention, a connecting pipe communicates between a lateral fitting of the pipe section, at which a section or intake can be connected to draw off the collected balls, and the trough, the mouth of this pipe opening into the trough.

The invention is based upon the fact that the cooling water duct downstream of a power plant condenser is generally free from obstructions so that both, the upstream end of the sieve and the downstream end thereof, can reach into respective portions of the pipeline adjoining the section which carries this sieve and is introduced into the pipeline when collection of cleaning particles or balls is desired.

As a consequence, the axial length of the pipe section in the flow direction is significantly reduced since it does not have to be provided directly with the collecting trough or box and indeed, the axial length of the pipe section need only be sufficient to accommodate the connecting flanges, the pivot or pivots for the sieve or sieves or the pipe fitting or fittings for the pipe or pipes which can communicate with the trough or troughs. Hence this pipe section may be a simple ring of comparatively small axial length.

According to a feature of the invention, the trough where provided on the downstream end of the sieve can constitute a semi-box structure while the wall portion which is not mounted on or connected to this sieve cooperates therewith to define the collecting box. In other words, the trough can be defined between a wall portion of the pipeline downstream of the pipe section and a laterally open L-section member which is carried by the downstream end of the sieve.

According to another embodiment of the invention, the pipe section or housing of the device can be provided with an apron extending in the flow direction beyond the downstream flange and connected thereto or forming a part thereof and constituting the wall portion with which the structure on the sieve cooperates to form the collecting box.

The connecting pipe also may be of various configurations and constructions. In one embodiment, for example, the fitting is fastened on the housing and the connecting pipe extends through this housing at least in part upstream of the ball-collecting sieve. The fitting can also be located at a point downstream of the ball-collecting sieve when the latter is in its operative position so that all or a portion of the connecting pipe lies in the region of this housing downstream of the sieve and may even extend into the trough downstream of the sieve.

When the fitting is disposed upstream of the sieve, the tube can descend directly into the trough while remaining upstream or laterally of the sieve if desired.

The connecting pipe may have one or more bands enabling it to pass from a location upstream of the sieve at which it meets the connecting fitting to a location downstream of or behind the sieve.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
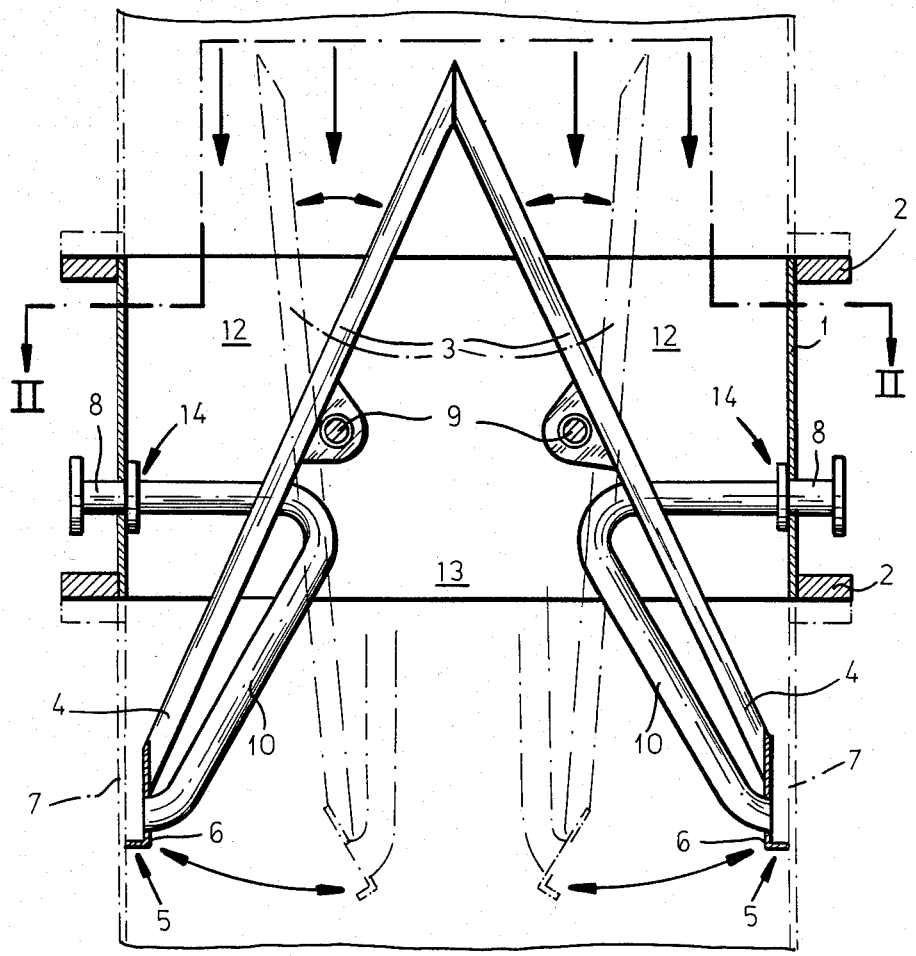
FIG. 1 is a vertical axial section through a device in accordance with the invention with the portions of the pipeline to which it is connected being shown in dot-dash lines.

The device shown in the drawing serves to recover cleaning balls from a cooling water stream of a power plant condenser provided with a ball circulation cleaning device adapted to remove deposits from the surfaces of the tubes of the condenser.

This device basically comprises a housing 1 in the form of a cylinder pipe section, having a connecting flange 2 at its upstream end and a connecting flange 2 at its downstream end for flanging this pipe section to the pipe sections of the pipeline downstream of the condenser and represented in dot-dash lines in FIG. 1.

A pair of ball-capturing sieves 3, each spanning half the cross section of the flow represented by the downwardly directed arrows in FIG. 1, are pivotally mounted as shown at 9 in the housing 1 for swinging movement above respective axes which are orthogonal to the axis of the pipeline and perpendicular to the flow direction. The sieves 3 can be swung from the solidlines positions shown in FIG. 1 (operative positions) to the dot-dash lines positions (inoperative positions), i.e. from positions in which they live across the stream to capture the balls into positions in which they are substantially parallel to the stream and thus do not collect particles from the water.

At the downstream end, the sieves 3 are formed with elliptical end portions represented at 4.

A cleaning ball-recovery unit generally represented at 5 is constituted by two parts 6 and 7 which together define an upwardly open trough in the operative positions of the sieves 3 (FIG. 1) and with which withdrawal pipe fittings 8 fixed in the housing 1 are connected.

Each elliptical sieve end 4 thus has a part which forms the completed collecting trough 5 with a wall portion 7, the wall portion 7 being independent of the sieve 3 and, in the embodiment of FIG. 1, being a portion of the wall of the tube downstream from the pipe section 1. A connecting pipe 10 communicates between each fitting 8 and the respective collective trough 5 so that the collective balls can be drawn away for circulation or the like. Consequently, the parts 6 carried by the respective sieves can be considered semi-box structures which are completed by the wall portions 7 to the box-like configuration forming the trough.

Figure 3:
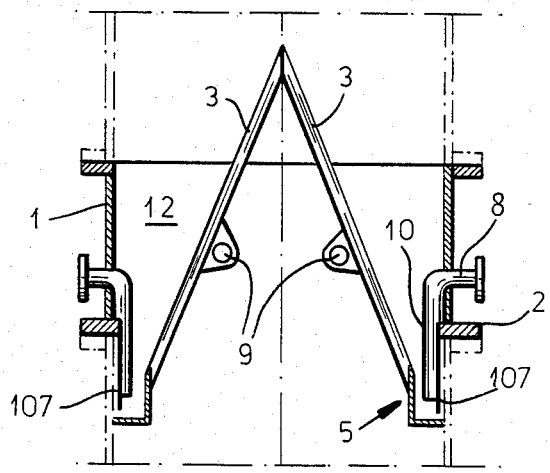
FIG. 3 is a view generally similar to that of FIG. 1 but in a more diagrammatic form and to a smaller scale illustrating another embodiment of the invention.
Figure 4:
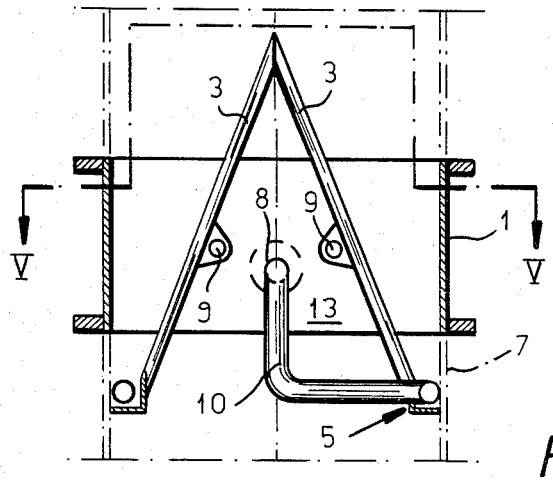
FIG. 4 is a view similar to FIG. 3 showing still another embodiment.
Figure 5:
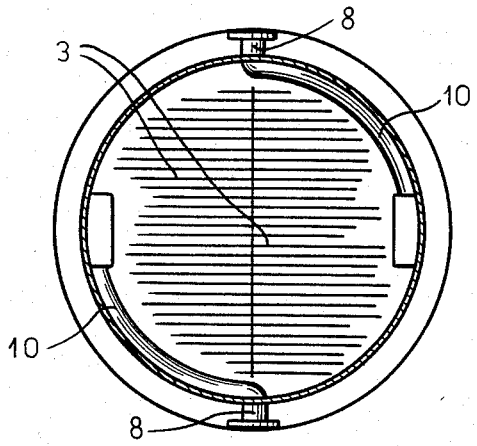
FIG. 5 is a diagrammatic section taken along the line V—V of FIG. 4.

In FIG. 3, the wall portion 107 is formed not by the adjoining portion of the pipeline or duct but rather by an apron affixed to the downstream flange 2 of the pipe section 1. In the embodiments of FIGS. 4 and 5, of course, the wall section with which the L-section member 6 cooperates, is the wall of the adjoining portion of the duct.

Figure 2:
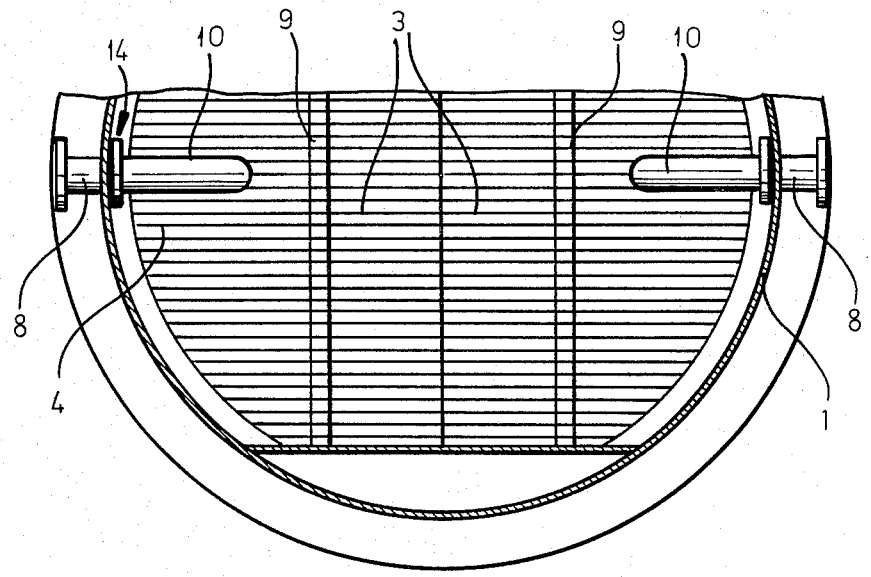
FIG. 2 is a cross section of the device of FIG. 1 taken along the line II—II thereof.

In the embodiments of FIGS. 1 through 3, the fittings 8 of the housing 1 are in each case mounted in the housing in a region 12 upstream of the sieves 3. In the embodiments of FIGS. 4 and 5, however, the fitting 8 is located downstream of the sieve surfaces in the operative positions of the sieves, i.e. in the region 13.

In the embodiment of FIG. 3, the connecting pipe 10 lies entirely in the upstream region 12 and descends directly via a band into a truck whereas in the embodiment of FIG. 1, the connecting pipe 10 can reach through the respective sieve to communicate with the trough within the downstream region 13 and in this case the pipe is disconnected from the fitting 8 when the sieve is swung into its inoperative position.

In the embodiment of FIGS. 4 and 5, however, the pipe 10 lies practically entirely within the downstream region. In another embodiment in which the pipe 10 is fixed to the sieve 3 and is swingable with the latter, the fitting 8 can be mounted in the housing in the region 13 downstream of the respective sieve.

The device shown in the drawing operates in the manner previously described to recover cleaning balls from the water leaving the condenser, the balls being collected on the seam and being guided from the respective troughs 5 from which they are withdrawn to the pipes 10 and the fittings 8. The small axial length of the pipe section 1 allows the device to be accommodated in existing condenser arrangements without difficulty.

I claim:

1. A device for recovering cleaning balls from a cooling water stream of a power plant condenser, having a pipeline and for use with a cleaning ball recirculating system, said device comprising:

a cylindrical pipe section forming a housing and provided with upstream and downstream flanges for connecting said housing to said pipeline;

at least one sieve pivotally mounted in said housing for displacement about an axis generally perpendicular to the direction of flow of said stream between an operative position wherein said sieve lies generally across said stream to collect cleaning balls therefrom, and an inoperative position, said sieve having a downstream end disposed downstream of and outside said pipe section in both said operative position and said inoperative position whereby said downstream end is located in a portion of said pipeline beyond said pipe section;

a ball collection part on said downstream end of said sieve cooperating with a wall portion independent of said housing and said pipe section and disposed downstream of a downstream one of said flanges to define a ball-collecting trough in said pipeline beyond said pipe section receiving balls captured from said stream in said operative position of said sieve;

a pipe fitting on said pipe section; and a connecting pipe communicating between said pipe fitting and said trough for withdrawing collected balls from said trough.

2. The device defined in claim 1 wherein said part is formed as a semi-box structure and cooperates with said wall portion to complete a box configuration for said trough.

3. The device defined in claim 1 wherein said wall portion is a portion of the wall of a duct downstream of and adjoining said pipe section.

4. The device defined in claim 1 wherein said wall portion is an apron fixed to said housing and lying inwardly of said downstream flange and projecting downstream thereof.

5. The device defined in claim 1 wherein said fitting is disposed upstream of said sieve on said housing and said connecting tube lies at least in part upstream of said sieve.

6. The device defined in claim 1 wherein said pipe section fitting is fixed to said housing downstream of said sieve.

7. The device defined in claim 1 wherein said fitting is affixed to said housing upstream of said sieve and said pipe extends from said fitting to said trough entirely upstream of said sieve.

8. The device defined in claim 1 wherein said connecting pipe is affixed to said sieve and is swingable therewith between said positions.

9. The device defined in claim 8 wherein said connecting pipe is joined to said fitting upon displacement of said sieve into said operative position.

10. The device defined in claim 8 wherein said fitting is disposed downstream of said sieve.

11. The device in claim 8 wherein said fitting is disposed upstream of said sieve and said pipe section communicates with said fitting upstream of said sieve and has a bend whereby said connecting pipe passes into a region downstream of said sieve to communicate with said trough.

12. The device defined in claim 1 wherein said sieve is one of a pair of sieves disposed in mirrorsymmetrical relationship in said housing.

* * * * *